United States Patent [19]

Robbins, III

[11] Patent Number: 4,805,799

[45] Date of Patent: Feb. 21, 1989

[54] CONTAINER WITH UNITARY BLADDER

[76] Inventor: Edward S. Robbins, III, 459 N. Court St., Florence, Ala. 35630

[21] Appl. No.: 163,900

[22] Filed: Mar. 4, 1988

[51] Int. Cl.[4] ..... B65D 25/16

[52] U.S. Cl. ..... 220/403; 220/404

[58] Field of Search ..... 220/403, 404, 465, 462

[56] References Cited

U.S. PATENT DOCUMENTS

| | | | |
|---|---|---|---|
| 2,338,604 | 1/1944 | Silveyra . | |
| 2,352,503 | 6/1944 | Walton . | |
| 3,039,648 | 6/1942 | Busch . | |
| 3,163,544 | 3/1962 | Valyi . | |
| 3,179,323 | 4/1965 | Miller . | |
| 3,643,854 | 2/1972 | Holmes . | |
| 3,765,574 | 10/1973 | Urquiza . | |
| 3,918,605 | 11/1975 | Butler . | |
| 4,449,984 | 5/1984 | Cruz | 220/404 |
| 4,560,085 | 12/1985 | Vom Hofe et al. . | |
| 4,635,814 | 1/1987 | Jones | 220/403 |

*Primary Examiner*—George T. Hall

*Attorney, Agent, or Firm*—Nixon & Vanderhye

[57] ABSTRACT

A container includes a substantially rigid upper container segment, a flexible bladder integral with, and depending from, the upper container segment, and a lower substantially rigid container segment attached to the upper container segment so that the flexible bladder is housed therewithin. The upper container segment presents a smooth exterior continuation of the lower container segment so that the two segments visually appear to be formed in a unitary manner. A foldable hanger may be provided integrally on the bottom wall of the container so as to facilitate the container's supported inversion. In one embodiment, the bladder is spaced from the container bottom wall so as to establish a sub-container therebetween.

24 Claims, 2 Drawing Sheets

Fig. 1
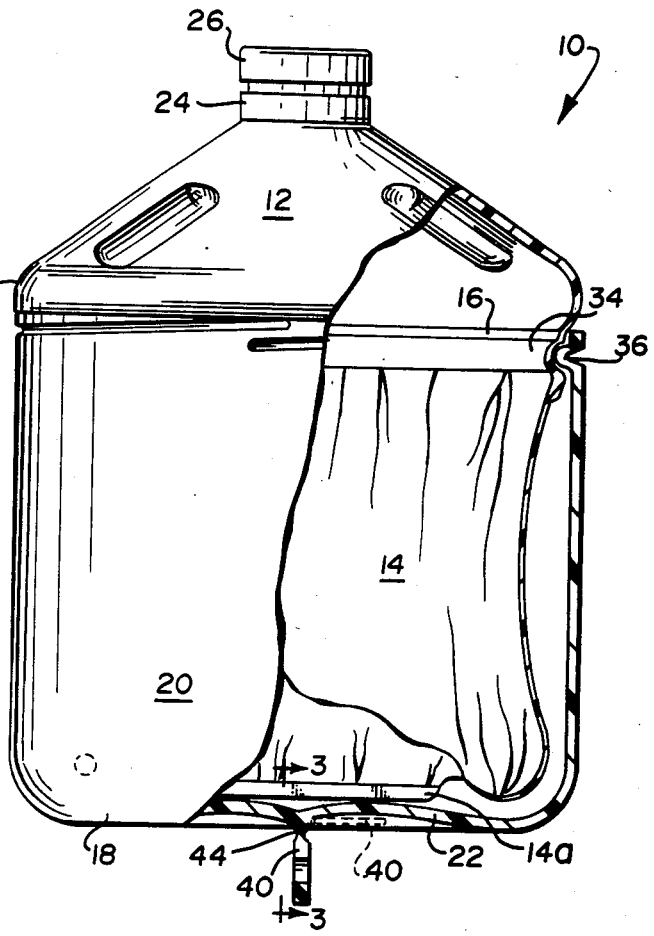
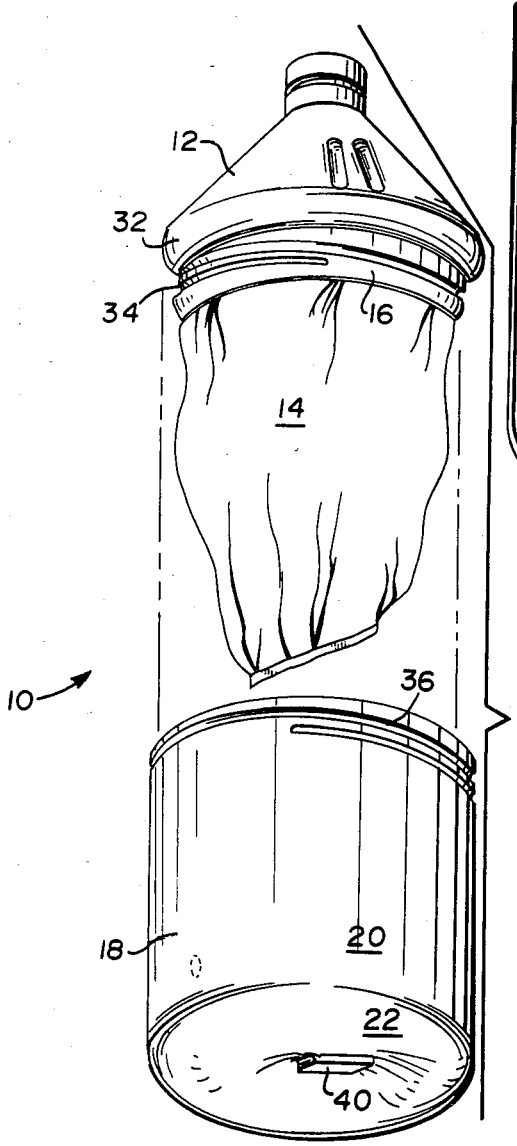
Fig. 2

CONTAINER WITH UNITARY BLADDER

FIELD OF THE INVENTION

This application relates to the field of containers generally. In its preferred embodiment, the invention more specifically relates to containers having unitary or integral bladders, liners or the like.

BACKGROUND AND SUMMARY OF THE INVENTION

Many uses actually and potentially exist for containers having internal bladders (hereafter simply called "bladder-type containers" for ease of reference). Bladder-type containers may thus be useful to transport, store and/or dispense a variety of liquid or solid materials for commercial, industrial and/or residential end-uses. For example, bladder-type containers could be used in hospital environments as a replacement for intravenous bags and in other environments as a convenient means to ship, store and dispense potable liquids (e.g., wine or other spirits). Those in this art will undoubtedly realize other possible beneficial uss for such bladder-type containers.

INFORMATION DISCLOSURE STATEMENT

Various proposals exist in the art to provide a flexible bladder within a substantially rigid walled container, attention being directed specifically to U.S. Pat. Nos. 3,163,544 to Valyi; 4,560,085 to Vom Hofe et al; 3,179,323 to Miller; 2,352,503 to Walton; 2,338,604 to Silveyra; 3,039,648 to Busch; 3,643,854 to Holmes; 3,918,605 to Butler; and 3,765,574 to Urquiza.

Valyi '544 and Vom Hofe et al '085 each disclose a bladder container in which the bladder includes a "thickened" upper portion which is adapted to being connected to an external container in which the bladder is housed. These thickened portions of Valyi '544 and Vom Hofe et al '085 do not extend upwardly from the container and thus do not define, collectively with the bladder, any meaningful volume. Thus, these thickened portions appear to be present merely for the purpose of defining an access opening to the bladder and for connecting the bladder to an upper rim of the container.

Miller '323, Walton '503, and Silveyra '604 suggest that a flexible bladder (which may be closed by means of a suitable cap—see, Miller '323 and Silveyra '604), is merely housed within an otherwise rigid external container.

Busch '648 suggests that a bottle, which may be formed from a flexible rubber (or rubber-like material) or flexible plastic, could have its upper portion formed into the shape of a cone which terminates in a neck. Threads are formed on the neck so that a cap having matching threads may be coupled to the neck thereby closing the bottle. The bottle is housed within a metal sheath and is held therein by a plurality of inwardly bent finger structures.

Holmes '854 discloses a container for paints and other like liquids. The container of Holmes '854 includes a carton erected from a collapsible tubular blank, a rectangular lid which is secured to the top of the carton, and a flexible bag having an opening which is peripherally sealed to a skirt depending from the lid within the carton.

A combination container with disposable closure and liner assembly is disclosed in Butler '605 as having a closure element having a main body portion against which a neck of a liner is secured by a peripherally positioned clamp. The liner and main body portion are thus not integral with one another.

An open-ended flexible liner having a flanged collar ring may be inserted into a rigid external container according to Urquiza '574. An aperture is provided in the bottom wall of the external container so that, after the bag is inserted into the external container and filled, its open end may be heat-sealed.

SUMMARY OF THE PRESENT INVENTION

According to the present invention, a container is provided which is formed by means of a substantially rigid external container having upper and lower sections coupled to one another (as by mated threaded engagement, heat sealing, adhesive connection, and the like). A flexible liner or bladder is integral with the upper section of the container so that it dependently extends into the interior of, and is housed by, the lower section. The upper container section and the bladder thus collectively establish an interior volume for containing liquid and/or solid materials.

The lower section of the container may be provided with an integral, yet foldable hanger member associated with the lower section's bottom wall. The hanger member is particularly useful to permit inversion of the container of this invention and thus more easily facilitate the emptying of its contents. Thus, the hanger member may be provided in a stowed position such that it is substantially flush against the lower section's bottom wall (thereby presenting no obstacle to the container when it rests upon a flat surface), yet is capable of being folded into an extended position when it is desired to hang or otherwise support the container in an inverted condition.

The bottom of the bladder may also terminate in spaced relation to the bottom wall of the lower container section. In this embodiment of the invention, upper and lower sub-containers are provided in a unitary manner. That is, an upper sub-container is established by means of the interior of the bladder/upper container section, while a lower sub-container is established by means of the space existing between the exterior of the bladder and the interior of the lower container section. Thus, different (or the same) materials may separately fill the upper and lower sub-containers and remain segregated within the overall container. These materials may then be removed separately (as by separating the integral upper container section/bladder from the lower container section, or alternately, may be mixed within the overall container simply by rupturing the bladder.

Other advantages and aspects of this invention will become more clear to the reader after careful consideration is given to the following detailed description of the preferred exemplary embodiments.

BRIEF DESCRIPTION OF THE ACCOMPANYING DRAWINGS

Reference will hereinafter be made to the accompanying drawings, wherein like reference numerals throughout the various FIGURES denote like structural elements, and wherein;

FIG. 1 is an elevational view, partly in section, of a container in accordance with the present invention;

FIG. 2 is a an "exploded" bottom perspective view of the container shown in FIG. 1;

DETAILED DESCRIPTION OF THE PREFERRED EXEMPLARY EMBODIMENTS

Figure 3:
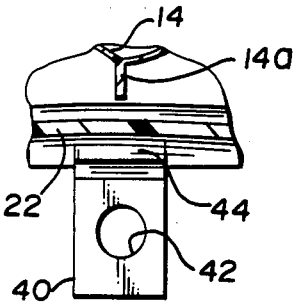
FIG. 3 is a detailed elevational view of the hanger member integrally formed on the bottom wall of the container shown in FIG. 1, and taken along line 3—3 therein.

A container 10 in accordance with this invention is shown in accompanying FIGS. 1 and 2 as generally including a substantially rigid upper container segment 12, a flexible bladder 14 integrally joined to the upper segment 12 at its lower flange 16, and a substantially rigid lower container segment 18. The upper container segment 12 and bladder 14 may be formed of any suitable plastic material (e.g., polyvinylchloride, or polyolefins such as polypropylene and polyethylene). Lower container segment 18, on the other hand may be formed of the same or different plastic material as compared to container segment 12. The lower container segment 18 is defined by a side wall 20 (which in the embodiment shown just happens to be cylindrical in configuration), and a bottom wall 22.

The upper container segment 12, in the embodiment shown, is generally conically shaped, terminating in a neck 24 so as to define an opening to the interior of bladder 14. However, it is to be understood that the upper container segment may be formed in any expedient or desired geometric configuration provided that it extends upwardly from the lower container segment 18 and thus defines a meaningful volume portion of the total volume established by container segment 12/bladder 14. The neck 24, and hence its defined opening, may conveniently be closed by means of a cap 26. The upper container segment 12 also preferably includes opposing depressed regions 28, 30 which collectively serve as handles to more readily facilitate handling and/or other manual manipulations of container 10.

The lower flange 16 of upper container segment 12 is inwardly radially recessed with regard to the upper segment's base periphery 32 so as to permit the flange 16 to be accepted within the upper portion of side wall 20. In such a manner, the container 10 presents, in external appearance, a smooth continuation of surfaces from the side wall 20 of lower container segment 18 to the base periphery 32 of upper container segment 12. Thus, the container segments 12 and 18 visually appear to be unitary with one another. This unitary appearance could be further enhanced by heat or adhesively sealing flange 16 to an opposing interior region of side wall 20. However, in the embodiment shown, the flange 16 is provided with threads 34 so as to mate with corresponding threads 36 on the upper region of side wall 20 and thus permit the upper container segment 12 to be removably coupled to lower container segment 18.

As is seen particularly in FIG. 1, the upper container segment 12 defines a meaningful portion (e.g., about one-fourth or more) of the total volume collectively defined by the upper segment 12 and its integral bladder 14. That is, since the upper segment 12 extends upwardly from its flange 16 (and hence its interconnection with the lower container segment 18), an additional volume of container capacity is provided as compared to containers which merely define an access opening by means of a thickened section associated with a flexible bladder. And, since a smooth continuity exists between the lower and upper segments, a container which is "unitary" in appearance is achieved as has been mentioned previously.

The bladder 14, as was briefly mentioned, is connected integrally to the rigid upper container segment 12 at flange 16. Thus, although the segment 12 and bladder 14 are formed of the same plastic material, their respective rigidity and flexibility is provided by the relative thickness of these structural elements. That is, the thickness of bladder 14 is such that it exhibits sufficient flexibility while the upper container segment 12 is several times as thick as bladder 14 and hence exhibits sufficient rigidity.

The integral upper container segment 12 and bladder 14 may be formed by any convenient plastic formation technique well known to those in this art. Preferably, the integral container segment 12/bladder 14 is formed according to the blow-molding techniques disclosed in copending U.S. application Ser. No. 008,658 filed Jan. 30, 1987 in the name of Edward S. Robbins, III (the entire content of this pending application being expressly incorporated hereinto by reference). The bladder 14 will be sealed at its lower end **14*a* (as by means of heat sealing or the like) so that the interior volume established collectively by the upper container segment 12 and the bladder 14 is accessible only through the opening defined by neck 24**.

The bottom wall 22 of lower container segment 18 is preferably slightly concave and includes a substantially centrally located integral hanger member 40. Hanger member 40 is normally stowed in a flush relationship against the bottom wall 22 (i.e., as is shown in dashed and solid lines in FIGS. 1 and 2, respectively), yet is capable of being folded (i.e., pivoted) into an extended position (as is shown in solid line in FIG. 1 and is more clearly shown in that position in FIG. 3) to facilitate supported inversion of container 10. In this regard, an aperture 42 may be defined in hanger member 40 so as to permit the container 10 to be supported in an inverted condition. Folding of hanger member 40 between its stowed and extended positions is enhanced by providing a region 44 of reduced cross-sectional thickness and thereby to provide an integral hinge with bottom wall 22.

Vent openings 46 may be defined in side wall 20 of lower container 10 as is shown in dashed line in FIGS. 1 and 2 so as to permit ambient air to enter the space defined between the bladder 14 and the lower container segment 18. Vents may also be provided by means of an interrupted thread arrangement on flange 16 and the upper region of lower container 18. Venting of ambient air into the lower container 18 thus permits the bladder 14 to be collapsed more easily when its contents are being emptied.

Figure 4:
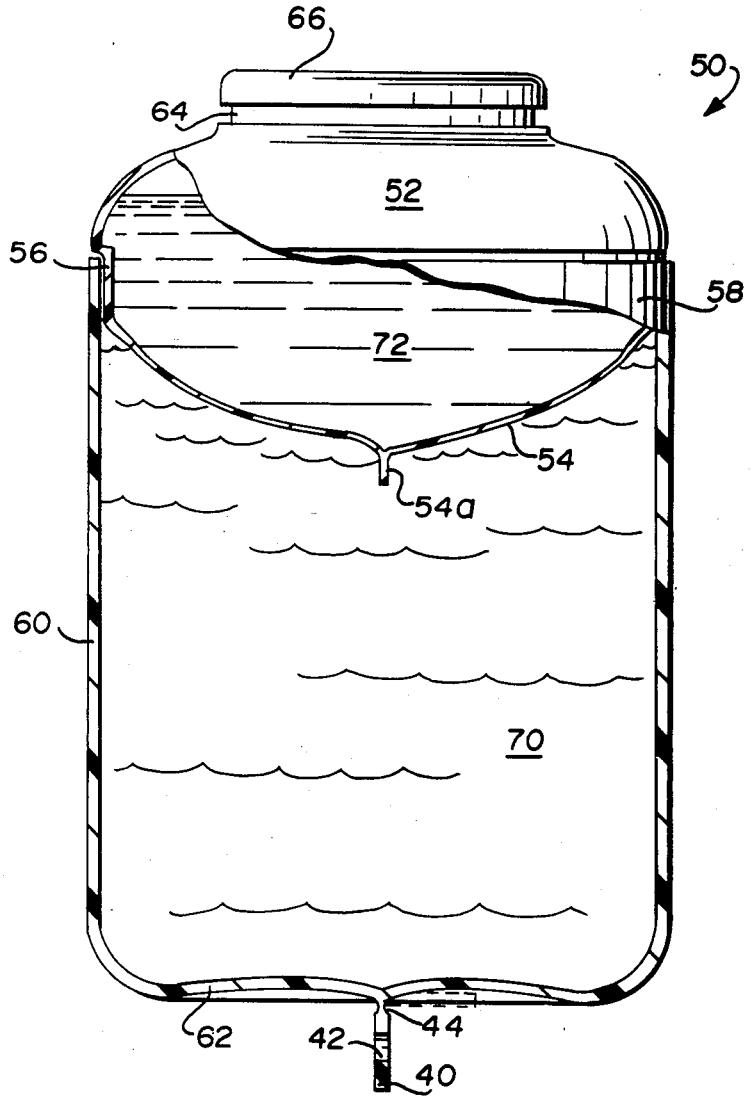
FIG. 4 is a elevational view, partly in cross-section of another container embodiment of this invention which is particularly adapted to provide separate sub-chambers therewithin.

FIG. 4 shows another embodiment of a container 50 according to this invention. Like container 10 discussed above with particular reference to FIGS. 1 and 2, container 50 of the embodiment shown in FIG. 4 includes a rigid upper container segment 52 (which, it will be noted, is of different geometric configuration as compared to the upper segment 12 of container 10 shown in FIGS. 1 and 2), a bladder 54 integrally connected to segment 52 at flange 56, and a lower rigid container segment 58. Flange 56 of container 50 is coupled to the interior region of side wall 60 of lower container segment 58 by means of heat sealing adhesive, or the like. Of course, threaded coupling between flange 56 and side wall 60 could be provided in a manner similar to that provided in container 10 shown in FIGS. 1 and 2. The bottom wall 62 of container 50 is likewise slightly concave and includes an integral hanger member 40. The upper container segment 52 also includes a neck region 64 which defines an opening covered by cap 66. (It will be noted that the diameter of neck 64 of container 50 is larger as compared to the diameter of neck 24 of container 10 and thus exemplifies that any dimensional and/or geometric configuration may be provided according to the invention so as to obtain access to the interior of the containers 10 and 50.)

The bottom 54*a* of bladder 54 is spaced from the bottom wall 62 of lower container segment 58 so as to establish a lower sub-container 70 therebetween in which liquid and/or solid material may be contained. The integral bladder 54 and upper container segment 52, on the other hand, collectively establish an upper sub-container 72 so as to contain another (or the same) liquid and/or solid therewithin. Thus, the material filling sub-containers 70 and 72 may be transported and stored in a segregated manner but may be mixed internally within the container 50 at the point of use simply by rupturing the bladder 54. That is, when it is desired to mix the material contents of sub-containers 70 and 72, a user may insert a sharp implement through opened neck 64 and thus puncture the bladder 54. Thereafter, the cap 66 may be replaced and the container 50 shaken so as to ensure adequate material mixing. Of course, the contents of sub-containers 70 and 72 may be used separately, in which case, it is preferred that the upper container segment 52 be provided with threads or like means so that it is removably coupled to the lower container segment 58.

When preparing the container 50 for use as a unitary mixing means for two materials, one of the materials will first be introduced into the lower container segment 58. That is, a predetermined volume of material is introduced into container segment 58 so that the material occupies the lower sub-container 72 when the upper and lower container segments are coupled to one another. The other material may then be introduced into the upper sub-container 70 (either before or after the upper and lower container segments 12, 18, respectively are coupled to one another) and the cap 66 is placed over neck 64. Thereafter, point-of-use mixture of the two materials in sub-containers 70 and 72 may be accomplished in the manner described above.

The embodiment of container 50 shown in FIG. 4 is thus advantageous to, for example, allow transport, storage and point-of-use mixture for two dissimilar liquids, a liquid and a solid, or two dissimilar solids, for example. This feature may be useful to prolong the useful life of a chemical mixture, for example, or to provide chemical reaction between the contents of sub-containers 70 and 72 at the point of use. And, container 50 may also be used to transport food stuffs, for example, a cereal and a liquid dairy product, so that they may be mixed just prior to consumption.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A container comprising:

a rigid upper container segment which establishes one portion of a total volumetric capacity for the container;

a rigid lower container segment;

means for coupling said upper and lower container segments one to another; and a flexible bladder which establishes a remaining portion of the total volumetric container capacity so that said upper container segment and said bladder collectively establish said total volumetric container capacity, said bladder being integrally formed with said upper container segment such that said bladder depends from said upper container segment and is housed within said lower container segment, wherein said upper container segment also defines an access opening to permit access to contents within said upper container segment and bladder.

2. A container as in claim 1, wherein said upper container segment defines an external base peripheral surface, and includes an annular flange inwardly radially recessed with respect to said base surface so that said flange is accepted within an upper region of said lower container segment.

3. A container as in claim 2, wherein said coupling means couples said flange and said upper region of said lower container segment.

4. A container as in claim 1, wherein said lower container segment includes a bottom wall, and the container further comprises hanger means attached to said bottom wall for facilitating supported inversion of the container.

5. A container as in claim 4, wherein said hanger means is connected to said bottom wall by means of an integral hinge so as to be foldable between a stowed position, wherein said hanger means is substantially flush against said bottom wall, and an extended position, wherein said hanger means extends from said bottom wall.

6. A container as in claim 5, wherein said hinge is provided by means of a region of reduced thickness.

7. A container as in claim 4, wherein said hanger means defines an aperture.

8. A container as in claim 5, wherein said bottom wall is concave such that said hanger means, in said stowed position thereof, presents no obstacle to the container when said lower container segment rests upon a surface.

9. A container as in claim 2, wherein said upper container segment is substantially conically shaped.

10. A container as in claim 9, wherein said upper container segment includes a neck region extending upwardly from said upper container segment, said access opening being defined by said neck region.

11. A container in claim 10, further comprising a cap removably connected to said neck region so as to close said defined opening thereof.

12. A container comprising:

upper and lower substantially rigid container segments coupled to one another so as to collectively establish a predetermined external container configuration; and a flexible bladder member integrally dependently provided with said upper container segment so that said bladder is housed substantially completely within said lower container segment, wherein said upper container segment establishes a base peripheral region, and includes an annular flange inwardly radially recessed with respect to said base region and sized so that said flange is accepted within an upper region of said lower container segment, said flange and upper region being coupled one to another so as to thereby couple said upper container segment to said lower container segment.

13. A container as in claim 12, wherein said lower container segment includes a bottom wall, and the container further comprises hanger means attached to said bottom wall for facilitating supported inversion of the container.

14. A container as in claim 13, wherein said hanger means is connected to said bottom wall by means of an integral hinge so as to be foldable between a stowed position, wherein said hanger means is substantially flush against said bottom wall, and an extended position, wherein said hanger means extends from said bottom wall.

15. A container as in claim 14, wherein said hinge is provided by means of a region of reduced thickness.

16. A container as in claim 13, wherein said hanger means defines an aperture.

17. A container as in claim 14, wherein said bottom wall is concave such that said hanger means in said stowed position thereof, presents no obstacle to the container when said lower container segment rests upon a surface.

18. A container as in claim 12, wherein said upper container segment is substantially conically shaped.

19. A container as in claim 18, wherein said upper container segment includes a neck region extending upwardly from said upper container segment, said access opening being defined by said neck region.

20. A container as in claim 19, further comprising a cap removably connected to said neck region so as to closed said define opening thereof.

21. A container as in claim 12 wherein, said lower container segment includes a bottom wall, and said bladder includes a closed terminal end which is spaced from said bottom wall, said bladder and said upper container segment collectively establishing an upper internal sub-container, and said bladder and said lower container segment establishing a lower internal sub-container by virtue of the spaced relation between said bladder terminal end and said bottom wall of said lower container segment.

22. A method of using a container so as to separately store and/or transport at least two materials, and then to allow the two materials to be mixed with one another internally of the container, said method comprising the steps of:

(a) selecting a container of the type having a rigid upper container segment, a flexible bladder integral with said upper container segment so as to establish therewith an upper sub-container in which one of said two materials is contained, and a lower container segment connected to the upper container segment and which establishes with said bladder a lower sub-container in which a second material is stored; and (b) rupturing the bladder so as to establish communication between said upper and lower sub-containers and thus allow mixing of said two materials contained therewithin.

23. A method of mixing at least two materials internally of a container of the type having a rigid upper container segment, a flexible bladder integral with the upper container segment so as to establish therewith an internal upper sub-container, and a lower container segment adapted to being connected to said upper container segment so as to establish with said bladder a lower sub-container, said method comprising the steps of:

(a) introducing a predetermined volume of one of the materials into said lower container segment so that when said upper and lower container segments are connected to one another, said predetermined volume of the one material occupies said lower sub-container;

(b) connecting said upper and lower container segments one to another;

(c) introducing the other material into said upper sub-container; and (d) rupturing the bladder so as to establish communication between said upper and lower sub-containers and thus allow mixing of said one and other materials therewithin.

24. A method as in claim 24, wherein step (c) is practiced before step (b).

* * * * *